US005732768A

United States Patent [19]

Fraulo

[11] Patent Number: 5,732,768

[45] Date of Patent: Mar. 31, 1998

[54] CONDENSER FOR AIR-CONDITIONING SYSTEMS FOR VEHICLES

[75] Inventor: Franco Fraulo, Torino, Italy

[73] Assignee: Magneti Marelli Climatizzazione S.r.l, Poirino, Italy

[21] Appl. No.: 799,934

[22] Filed: Feb. 13, 1997

[30] Foreign Application Priority Data

Feb. 26, 1996 [IT] Italy ..... TO96A0130

[51] Int. Cl.[6] ..... F28D 1/04

[52] U.S. Cl. ..... 165/151; 165/81; 165/906

[58] Field of Search ..... 165/181, 149, 165/151, 906, 81

[56] References Cited

U.S. PATENT DOCUMENTS

| | | | |
|---|---|---|---|
| 1,459,318 | 6/1923 | Birdsall | 165/81 X |
| 1,895,287 | 1/1933 | Lambert | 165/151 |
| 1,916,656 | 7/1933 | Clarke | 165/81 |
| 1,921,278 | 8/1933 | Young | 165/81 |
| 3,149,667 | 9/1964 | Astrup | 165/151 |
| 4,592,420 | 6/1986 | Hughes | 165/151 |
| 4,738,225 | 4/1988 | Juang | 165/151 X |
| 4,799,540 | 1/1989 | Pietzcker | 165/181 X |

FOREIGN PATENT DOCUMENTS

| | | |
|---|---|---|
| 0633435 | 11/1995 | European Pat. Off. . |
| 1602080 | 11/1970 | France . |
| WO9427105 | 11/1994 | WIPO . |

*Primary Examiner*—Denise L. Ferensic
*Assistant Examiner*—Christopher Atkinson
*Attorney, Agent, or Firm*—Sughrue, Mion, Zinn, Macpeak & Seas, PLLC

[57] ABSTRACT

A condenser for air-conditioning systems for vehicles comprises at least one row of tubes fixed to a pack of substantially flat fins by the mechanical expansion of the tubes after they have been inserted in aligned holes in the fins. At least a substantial number of the fins have side portions which are thicker than the remaining portions of the fins.

1 Claim, 3 Drawing Sheets

CONDENSER FOR AIR-CONDITIONING SYSTEMS FOR VEHICLES

BACKGROUND OF THE INVENTION

The present invention relates to a condenser for air-conditioning systems for vehicles.

More precisely, the invention relates to a condenser of the so-called mechanically-assembled type, comprising at least one row of tubes fixed to a pack of substantially flat fins by the mechanical expansion of the tubes after they have been inserted in aligned holes in the fins.

Condensers for vehicle-air-conditioning systems constitute a very special class of heat exchangers because of the severe operating conditions to which they are subjected. The pressures inside the tubes may reach values of the order of 30 bars before a safety system intervenes, switching off the system. The operating temperatures of the condenser reach peak values of 120°–140° C. These working conditions substantially differentiate the structural characteristics of a condenser from those of other types of heat exchangers present in a vehicle.

Condensers produced by the braze-welding assembly technique use tubes having a plurality of micro-ducts separated from one another by partitions or ribs which enable the tube to withstand the severe operating conditions without undergoing permanent deformation or damage with leakage of coolant to the exterior. Although condensers of this type have optimal performance from the point of view of their heat-exchange capacity and optimal structural strength, they have the disadvantage of a very high cost.

Mechanically-assembled condensers are cheaper than braze-welded ones but generally have inferior heat-exchange efficiency. This is due mainly to the fact that the mechanical assembly technique uses tubes with circular cross-sections the stable shape of which enables them to withstand the high pressure levels present in the system. However, the shape of the tubes greatly penalizes the heat-exchange performance of the condenser.

The Applicant's document EP-A-0 633 435 describes a mechanically-assembled condenser with tubes having oblong cross-sections. Tubes of this type considerably improve the performance of the condenser in terms of heat-exchange efficiency. However, tubes with oblong cross-sections present difficulties from the point of view of structural strength. The aforementioned document EP-A-0 633 435 overcomes the problem of the inferior structural strength of tubes with oblong cross-sections in comparison with tubes with circular cross-sections with the use of particular dimensions of the entire assembly of tubes and fins.

The structure of the heat-exchanger described in this document has given optimal experimental results and can withstand the normal thermal and mechanical stresses which arise during use in a vehicle.

However, tests have shown that there are still critical points from the point of view of structural strength, particularly when the condenser is subjected to laboratory tests which produce stress conditions much more severe than those which normally arise during the use of the condenser in a vehicle.

In particular, laboratory tests have indicated the presence of weak points which may give way, particularly as a result of pulsed-pressure stress tests. A typical test of this type provides for the condenser to be brought to a temperature of about 100° C. and for the tubes to be stressed from inside by a pressure variable alternately between 5 and 30 bars at a frequency of the order of 0.5–3 Hz.

SUMMARY OF THE INVENTION

The object of the present invention is to provide improvements to mechanically-assembled condensers with tubes having oblong cross-sections, which eliminate or reduce the risks of their giving way even in pulsed-pressure test conditions.

According to the present invention, this object is achieved by a heat exchanger having the characteristics forming the subject of the main claim.

More precisely, it has been noted that, during pulsed-pressure stress tests, the end tubes of the row constitute the points with the greatest probability of giving way. According to the present invention, in order to overcome this problem, fins with thicker end regions are used. The increased thickness is preferably achieved by the bending of an end portion of each fin onto itself.

This characteristic achieves a greater restraining effect on the pack of fins, this effect being concentrated in the region of the outer tubes of the row, thus compensating for the greater structural weakness of these tubes.

BRIEF DESCRIPTION OF THE DRAWINGS

Further characteristics and advantages of the present invention will become clear in the course of the following detailed description, given purely by way of non-limiting example, with reference to the appended drawings, in which.

DETAILED DESCRIPTION OF THE INVENTION

Figure 1:
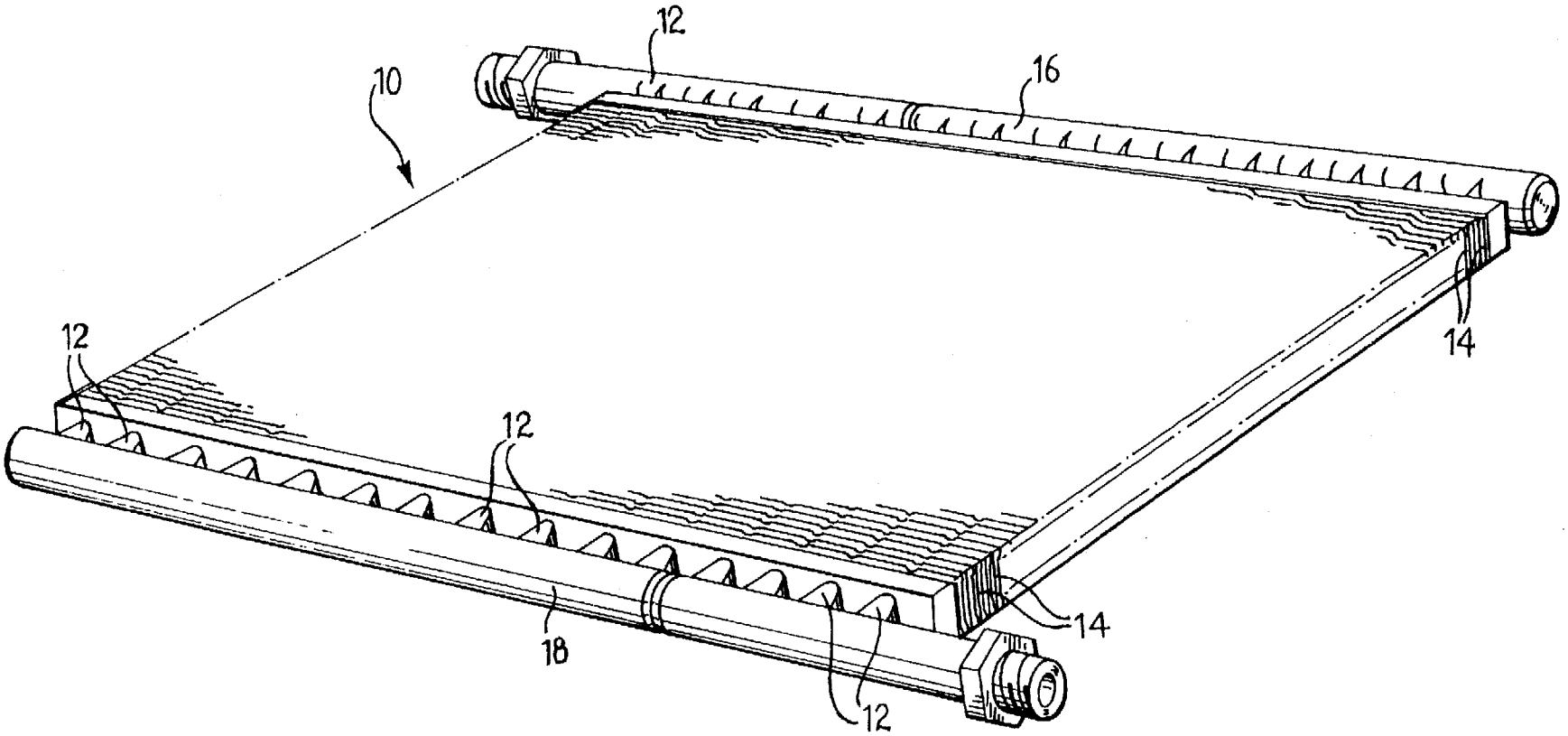
FIG. 1 is a schematic, perspective view of a condenser according to the present invention.
Figure 2:
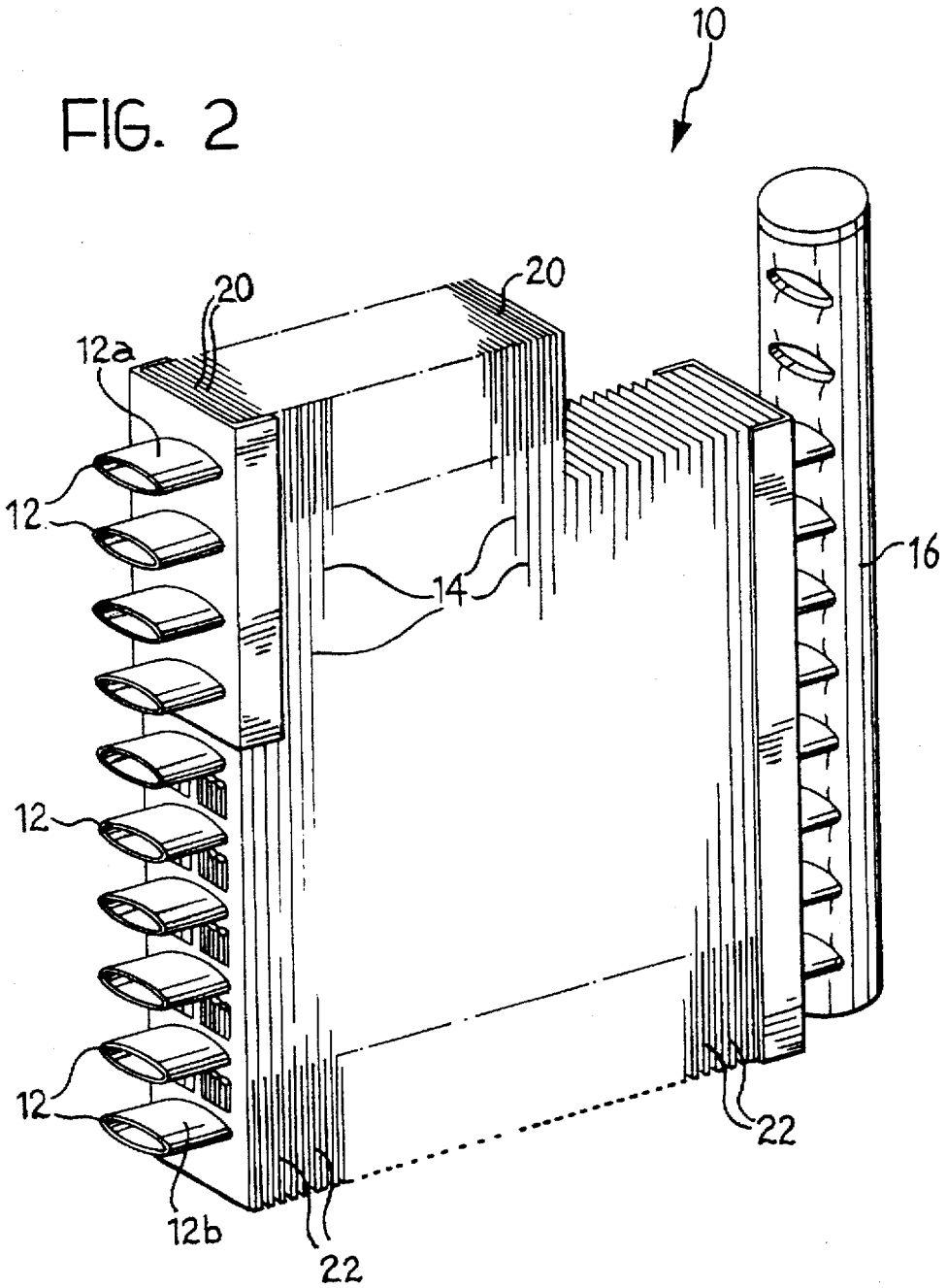
FIG. 2 is a schematic, perspective view of the condenser of FIG. 1.

With reference to FIGS. 1 and 2, a condenser for air-conditioning systems for vehicles is indicated 10. The condenser 10 comprises a row of tubes 12 with oblong cross-sections which, in the specific case, are oval. Each tube 12 is inserted in a series of aligned holes formed through substantially flat fins 14 superimposed on one another so as to form a pack. The tubes 12 are connected to the fins 14 by the mechanical expansion of the tubes after they have been inserted through the aligned holes in the fins with slight clearance. The ends of the tubes which project from the pack of fins 14 are braze-welded to respective manifolds 16 and 18.

Experimental structural-strength bests have shown that the tubes, indicated 12*a* and 12*b* in FIG. 2, which are disposed at the ends of the row are more exposed to the risk of breakage, particularly in the presence of pulsed internal pressure which causes fatigue stressing of the system.

According to the invention, in order to increase the structural strength of the end tubes 12*a* and 12*b*, fins 14 having side portions 20, 22 which are thicker than the remaining portions of the fins 14 are used. The thicker portions 20 and 22 may be provided on each fin 14 or at least on a substantial number of the fins 14.

Figure 3:
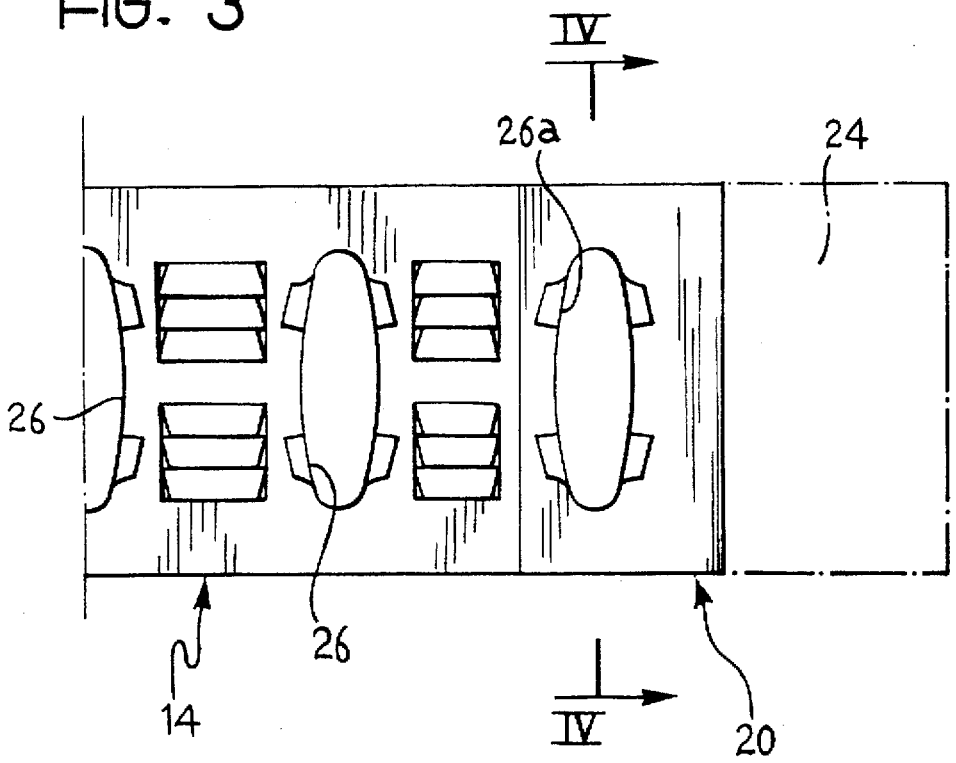
FIG. 3 is a plan view of an end region of a fin.
Figure 4:
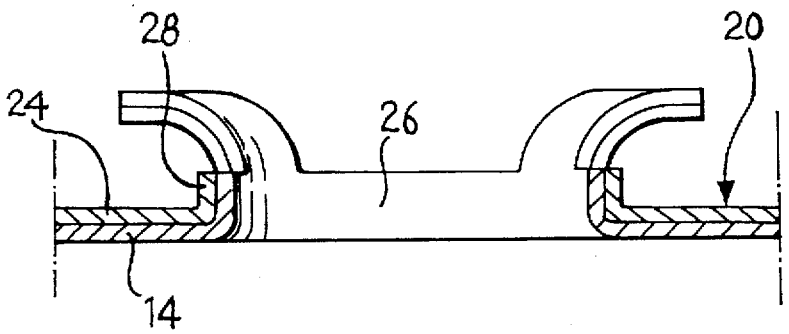
FIG. 4 is a section taken on the line IV—IV of FIG. 3.

As shown in FIGS. 3 and 4, the thicker portion 20 is preferably produced by the bending of an end portion 24 of the fin 14 onto itself. After the bending, holes 26 for the passage of the tubes 12, and the respective collars 28, are formed in the fins 14 by a known technique.

In the preferred embodiment, the holes for housing the end tubes 12*a*, 12*b* are formed entirely in the thicker portion 20.

What is claimed is:

1. A condenser for air-conditioning systems for vehicles, comprising at least one row of tubes fixed to a pack of substantially flat fins by the mechanical expansion of the tubes after they have been inserted in aligned holes in the fins, wherein at least a substantial number of the fins have side portions which are thicker than the remaining portions of the fins, and wherein the tubes disposed at the ends of the row are inserted through holes formed entirely through the thicker side portions.

* * * * *